US006023798A

United States Patent [19]

Hui

[11] Patent Number: 6,023,798

[45] Date of Patent: Feb. 15, 2000

[54] PILLOW ADJUSTER

[75] Inventor: Cheung Wing Hui, Hong Kong, The Hong Kong Special Administrative Region of the People's Republic of China

[73] Assignee: Hotung Investment Limited, Road Town, Virgin Islands (Br.)

[21] Appl. No.: 09/035,073

[22] Filed: Mar. 5, 1998

[51] Int. Cl.[7] ..... A47G 9/02

[52] U.S. Cl. ..... 5/490; 5/486; 5/482; 5/636

[58] Field of Search ..... 5/498, 486, 482, 5/417, 420, 640, 636

[56] References Cited

U.S. PATENT DOCUMENTS

| | | | |
|---|---|---|---|
| 2,682,673 | 7/1954 | Myers | 5/490 |
| 3,242,511 | 3/1966 | Fultz et al. | 5/490 X |
| 4,726,085 | 2/1988 | Antonio | 5/490 X |
| 4,754,513 | 7/1988 | Rinz | 5/490 |
| 4,766,626 | 8/1988 | Green | 5/420 |
| 4,788,728 | 12/1988 | Lake | 5/490 X |
| 4,887,326 | 12/1989 | O'Brien et al. | 5/490 X |
| 5,408,712 | 4/1995 | Brun | 5/486 X |
| 5,570,474 | 11/1996 | Berry et al. | 2/104 |
| 5,572,753 | 11/1996 | Ruscitto | 5/490 |

*Primary Examiner*—Terry Lee Melius
*Assistant Examiner*—Rodrigo J. Morales
*Attorney, Agent, or Firm*—Leydig, Voit & Mayer

[57] ABSTRACT

An adjuster (100) for use on a pillow, comprising a sheet-like flexible body (200) which is foldable up or down onto itself to provide different thicknesses and has, at or close to a lower edge, a central region (400). The region (400) has a zero or relatively much smaller thickness than that of the body (200) such that opposite sides of the region (400) provide a relatively larger thickness and hence firmer support than the region (400). The region (400) may preferably be a gap (400) formed between a pair of opposed flaps (300) protruding from the body (200).

15 Claims, 4 Drawing Sheets

PILLOW ADJUSTER

The present invention relates to an adjuster for adjusting the effective thickness of a pillow.

BACKGROUND OF THE INVENTION

Sleeping is an important part of life for every person. Ideally, every pillow should be tailor-made to suit the physical and personal preference of each individual person. Whilst pillows of various designs and constructions are available on the market, none of them can be regarded as tailor-made. A sleeping person frequently changes his position, such as sleeping on his back and on his side. Strictly speaking, these sleeping positions require different support for the head because the level of the head will change. It is known that the head will need to be at a relatively higher position (by a difference of about 15 mm to 25 mm) when a person is sleeping on his side than when he is sleeping on his back. This adds to the problem of finding a suitable pillow.

SUMMARY OF THE INVENTION

According to the invention, there is provided an adjuster for use on a pillow, comprising a sheet-like flexible body which is foldable up or down onto itself to provide different thicknesses and has, at or close to a lower edge, a central region which has a zero or relatively much smaller thickness than that of the body such that opposite sides of the region provide a relatively larger thickness and hence firmer support than the region.

Preferably, the region is in the form of a gap.

More preferably, the body includes a pair of opposed extensions protruding out from the lower edge to form the gap between them.

In a preferred embodiment, the region has opposite sides extending back-to-front and substantially parallel to each other.

Advantageously, the body is provided with fold lines extending between left and right sides of the body.

In a specific construction, the body is formed by two outer sheets of fabric and a middle layer of filling material, all being stitched together.

More specifically, the body is provided with stitched fold lines extending between left and right sides.

It is preferred that the body has a substantially uniform outer width matching that of the pillow.

The invention also provides a combination of the aforesaid adjuster and a wrapper for wrapping the adjuster against an upper side of the pillow.

Preferably, the wrapper is provided at opposite ends with hook-and-loop fasteners for inter-engagement.

It is preferred that the combination includes the pillow.

BRIEF DESCRIPTION OF DRAWINGS

The invention will now be more particularly described, by way of example only, with reference to the accompanying drawings, in which.

DETAILED DESCRIPTION OF PREFERRED EMBODIMENT(S)

Figures 1A, 1B:
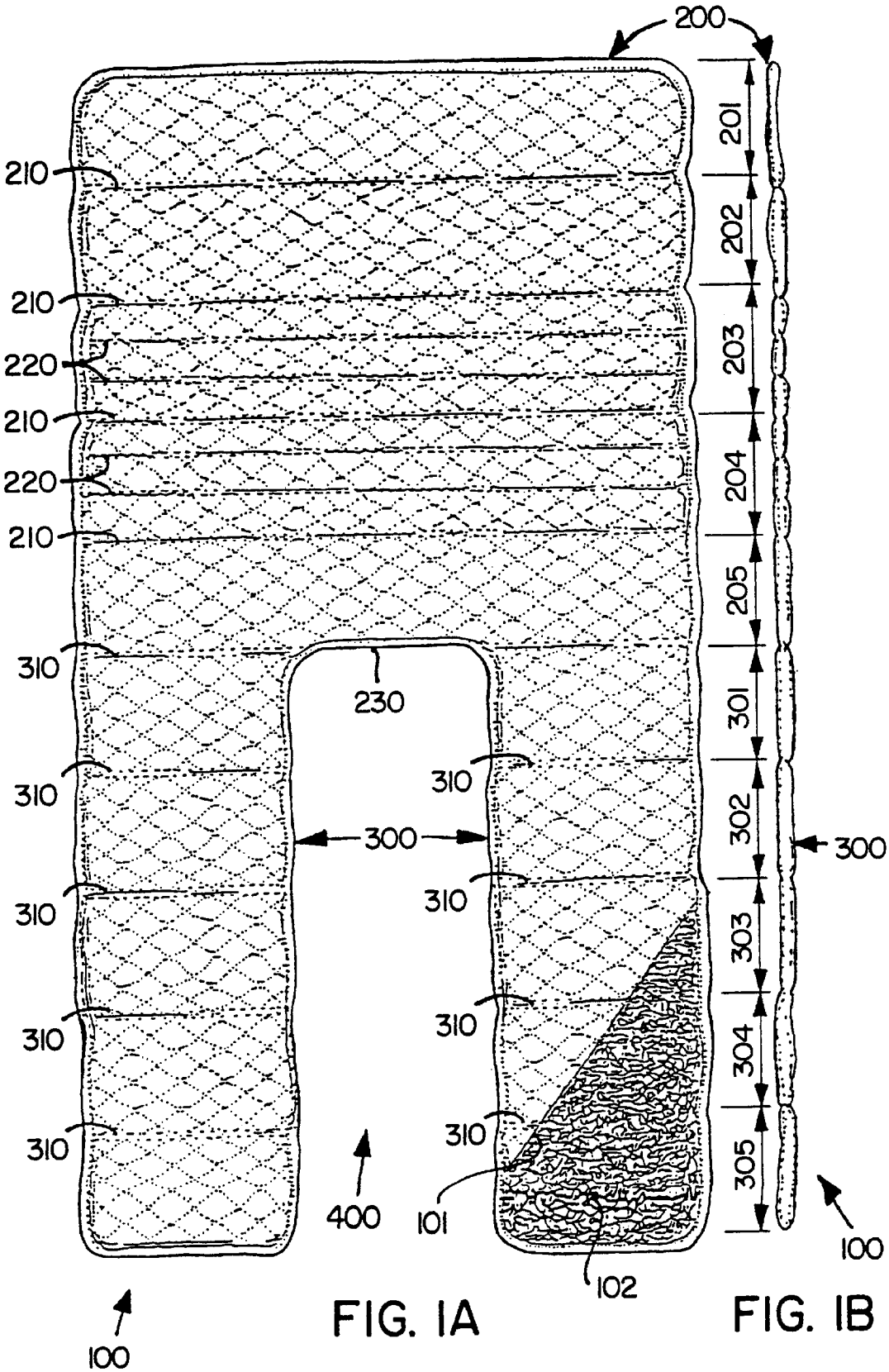
FIGS. 1A and 1B are top plan and side views of an embodiment of a pillow adjuster in accordance with the invention.

Referring firstly to FIGS. 1A and 1B of the drawings, there is shown a pillow adjuster 100 embodying the invention, which has a rectangular sheet-like flexible body 200 having a lower edge 230 and a pair of opposed rectangular flaps 300 protruding out from opposite ends of the edge 230. Each flap 300 extends about one-third across the edge 230, whereby a central gap 400 of similar size and shape is formed between the flaps 300. Opposite sides of the gap 400 extend parallel to each other. The overall shape of the adjuster 100 resembles that of a letter "U" inverted as shown.

The pillow adjuster 100 is formed by two outer sheets of fabric 101 and an inner layer of filling material 102 such as polyester wool, which have generally the same shape and size and are stitched together around the border and in the widthwise direction of the adjuster 100 in a diamond pattern. The adjuster body 200 is divided by horizontal stitch lines 210 into five equal sections 201 to 205. Each flap 300 is divided by horizontal stitch lines 310 into five equal sections 301 to 305. The stitch lines 210 and 310 define fold lines for the body 200 and flaps 300 to be readily foldable. The third and fourth body sections 203 and 204 are stitched with additional closer fold lines 220. The body 200 and flaps 300 are made to have a thickness between 7 mm and 8 mm and preferably of about 7.5 m, with the gap 400 providing, in effect, a zero thickness.

Figure 2A:
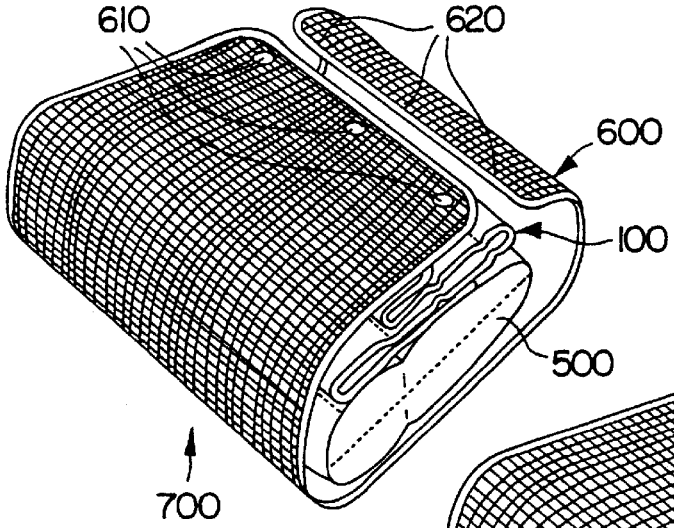
FIGS. 2A to 2C are two perspective views and a side view showing the use of the adjuster of FIGS. 1A and 1B on a pillow.
Figure 2B:
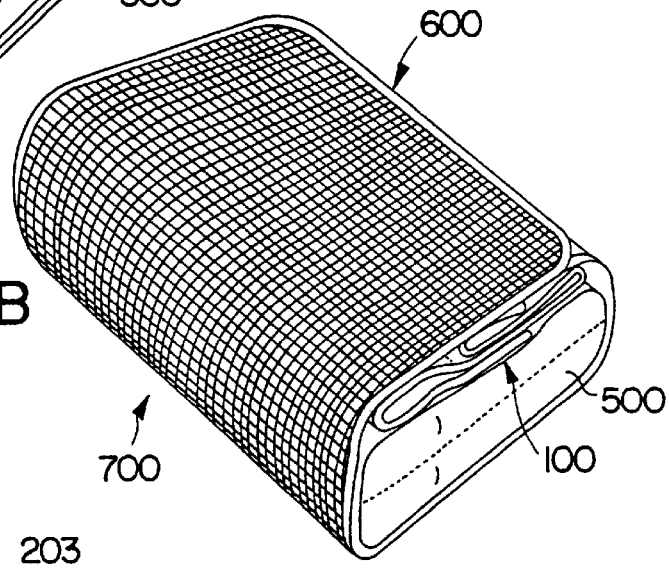
Figure 2C:
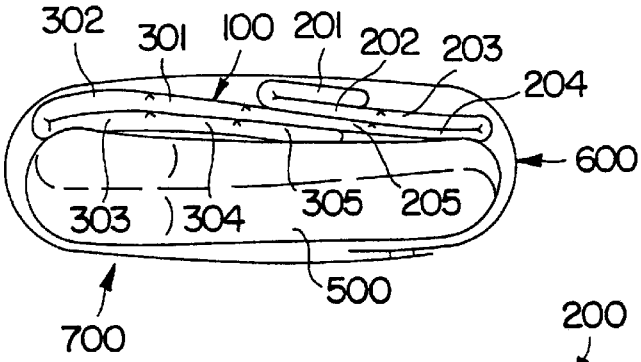

As shown in FIGS. 2A to 2C, the adjuster 100 is to be used on a pillow 500, with the fold lines 210/220 and 310 of FIG. 1A lying along the longitudinal extent of the pillow 500 and with the flaps 300 facing a sleeper. A rectangular sheet-like wrapper 600 is used to hold the adjuster 100 against is the upper side of the pillow 500, thereby forming a one-piece pillow assembly 700, as well as for protection. The wrapper 600, which is made sufficiently long to wrap around the pillow 500 and adjuster 100, is fitted with hook-and-loop fastening tapes 610 and 620 at opposite ends for inter-engagement. In use, the adjuster 100 is folded into one of various different conditions for adjusting the effective thickness and/or support of the pillow assembly 700 to fit the sleeper.

Figure 3:
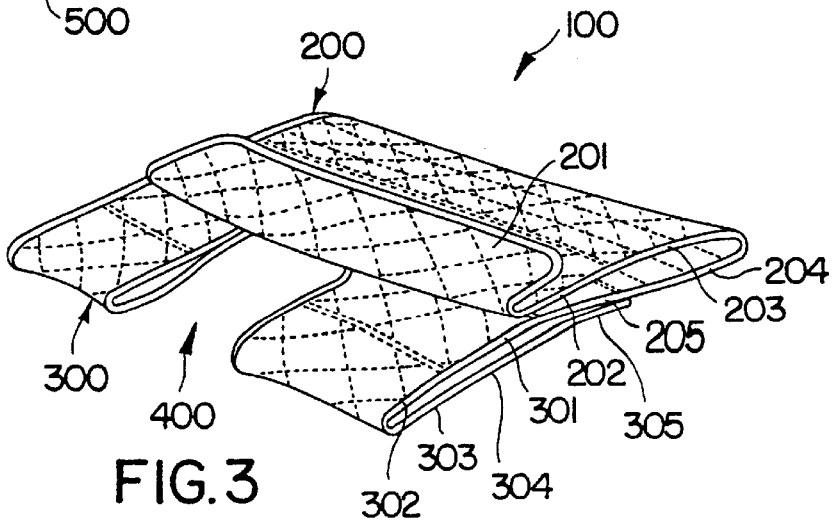
FIG. 3 is a perspective view of the adjuster of FIGS. 1A and 1B, showing one possible manner in which the adjuster is folded.

FIG. 3 shows one possible manner of folding the adjuster 100, in which (a) the first body section 201 is folded to lie above the second body section 202, (b) the second and third body sections 202 and 203 are folded to lie above the fifth and fourth body sections 205 and 204, and (c) on each side, the third to fifth flap sections 303 to 305 are folded to lie below the second and first flap sections 302 and 301 and fifth body section 205.

Figure 4A:
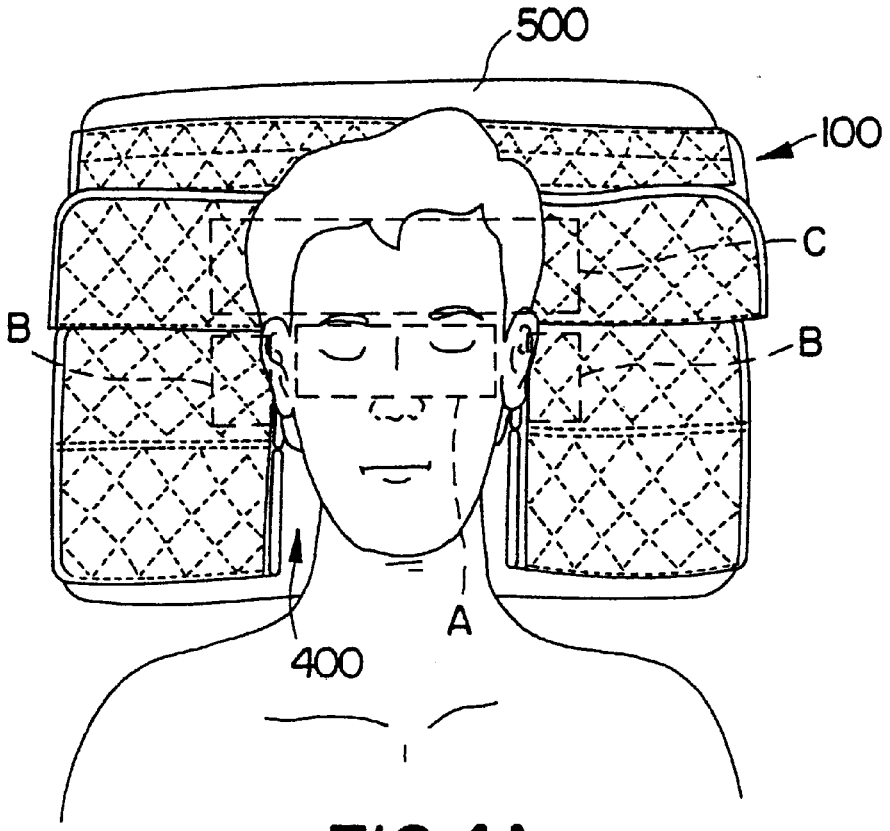
FIGS. 4A and 4B are a top plan view and a side view showing the use of the pillow and adjuster of FIGS. 2A to 2C by a person sleeping on his back, with the adjuster folded in the manner shown in FIG. 3.
Figure 4B:
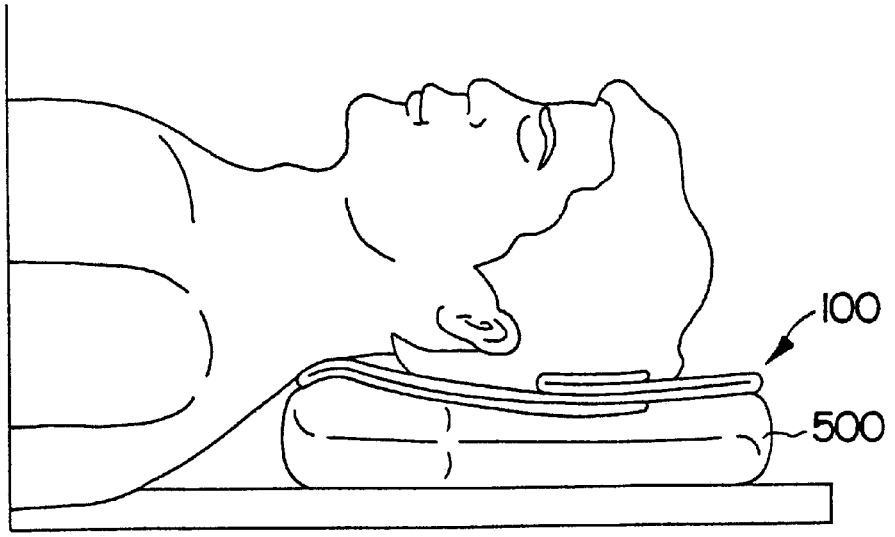

Reference is also made to FIGS. 4A and 4B, which show a person sleeping on his back on the pillow assembly 700 (without the wrapper 600 for clarity) with the adjuster 100 folded in the aforesaid manner. The rearmost part of the back of the person's head is essentially supported directly by the pillow 500 through the gap 400 having no thickness (region A). The person's neck is wholly supported by the pillow 500 directly. Opposite sides of the back of the head are guarded (or supported if the head is shifted slightly to either side) by the first and fourth flap sections 301 and 304 on opposite sides of the gap 400 (regions B), which provide an adjuster thickness of about 15 mm (compared with the zero adjuster thickness at region A) on each side for stable positioning of the head.

The upper part (beyond the rearmost part) of the back of the head (which is rounded) is supported by the middle part of the first, second and fifth body sections 201, 202 and 205 (region C). Region C provides an adjuster thickness of about 22.5 mm at the centre (through the gap 400) and about 30 mm on each side (off the gap 400).

Figure 5A:
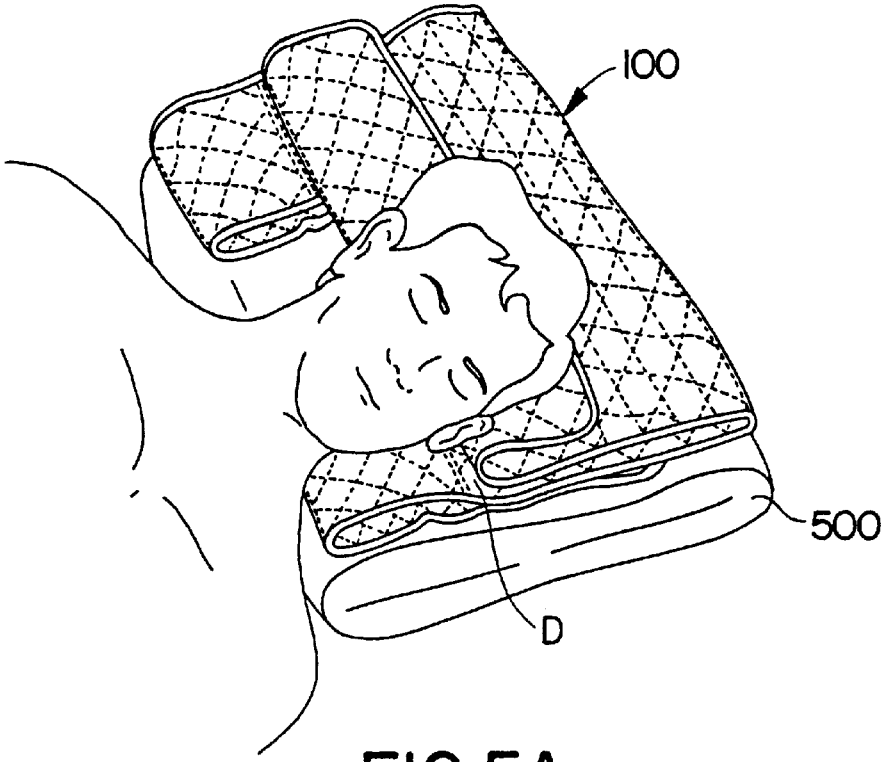
FIGS. 5A and 5B are a perspective view and a side view corresponding to FIGS. 4A and 4B, showing the person sleeping on his side.
Figure 5B:
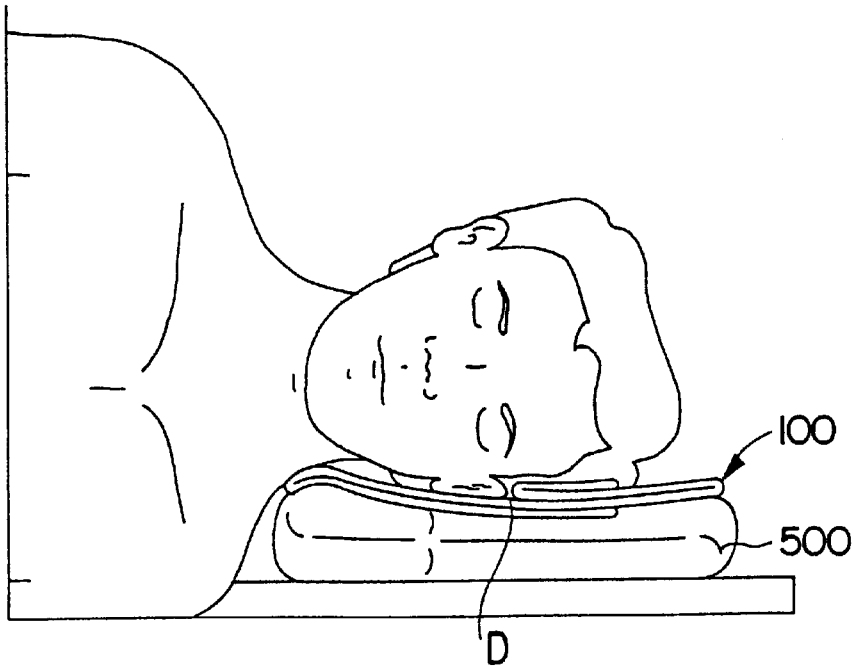

The person will, every now and again, roll to sleep on one side, such as the left side as shown in FIGS. 5A and 5B. In this position, his head will rest across the left side of region C, which provides an adjuster thickness of about 30 mm, and region B, which provides an adjuster thickness of about 15 m. As the left side of region C has a relatively larger thickness, it provides the main support for the head resting on that side. Such a support is relatively firmer (by reason of the thickness of about 30 mm) compared with that provided by region A (having no thickness) and the centre of region C (having a thickness of about 22.5 mm) when the person was sleeping on his back as described above.

Such a thicker/firmer support subtly offers an osteological advantage because the head on one side will need relatively more support, than when facing upwards, as it will be elevated by the shoulder. More support means that the neck part of the spine can be kept as straight as possible when the person is sleeping on his side, for a good posture as well as easier breathing.

In addition, step D having a depth of about 15 mm formed between the first body section 201 and the second flap section 302 will allow free space for the person's left ear, thereby adding comfort.

As described above, the adjuster 100 is useful to alter the effective thickness and thus the firmness and/or supporting characteristics of the pillow 500. The adjuster body 200 is foldable as desired to suit an individual user. The gap 400 positioned on the side facing the user, together with the flaps 300 on opposite sides, provide a stable support for the head when the user is sleeping on his back as well as a thicker or firmer support when he is sleeping on his side.

The adjuster 100 is particularly suitable for use with an existing type of foam pillows generally known as contour pillows. A typical contour pillow has a recess which extends all the way across the left and right sides of the pillow body. The recess is meant to conform with the shape of the back of the head of a sleeper for, allegedly, keeping the neck part of the spine straight. However, it has been found that such an objective can hardly be fulfilled because the back of the head is where maximum support is needed, but the presence of the recess inevitably reduces the thickness and hence the firmness or support of the pillow at that position. This causes numerous cases of aches in the neck. With the use of the adjuster 100, the recess of a contour pillow can be filled to provide the support that is beneficial.

In a different embodiment, the outer fabric sheets 101 of the adjuster 100 may be made rectangular overall to cover not only the body 200 and flaps 300 and but also the region between the flaps 300 (previously where the gap 400 was), where no filling material is used (as before) to form a relatively much thinner region, practically of zero thickness, acting as the gap 400. This would provide a neater construction for the subject adjuster.

In a further different embodiment, the gap 400 or the relatively much thinner region may be provided somewhere within the border of the adjuster body 200, preferably at a position close to one side of the border, with the flaps 300 omitted.

The invention has been given by way of example only, and various other modifications of and/or alterations to the described embodiment may be made by persons skilled in the art without departing from the scope of the invention as specified in the appended claims.

What is claimed is:

1. A combination comprising:

a pillow having an upper side;

an adjuster for use on the upper side of the pillow, comprising a sheet-like flexible body which is foldable up or down onto itself to provide different thicknesses and has, at or close to a lower edge, a central region with portions of the body on opposite sides of the central region providing a relatively larger thickness and hence firmer support than the central region; and a wrapper for wrapping the adjuster against the upper side of the pillow.

2. A combination as claimed in claim 1, wherein the central region is in the form of a gap.

3. A combination as claimed in claim 2, wherein the body includes a pair of opposed extensions protruding out from the lower edge to form the gap between them.

4. A combination as claimed in claim 1, wherein the region has opposite sides extending substantially parallel to each other.

5. A combination as claimed in claim 1, wherein the body is provided with parallel fold lines.

6. A combination as claimed in claim 1, wherein the body is formed by two outer sheets of fabric and a middle layer of filling material stitched to the outer sheets.

7. A combination as claimed in claim 6, wherein the body is provided with stitched fold lines.

8. A combination as claimed in claim 1, wherein the body has a substantially uniform outer width matching a width of the pillow.

9. A combination as claimed in claim 1, wherein the wrapper is provided at opposite ends with hook-and-loop fasteners for inter-engagement.

10. A combination for use with a sleeping pillow comprising:

an adjuster to be disposed on a sleeping pillow, comprising a sheet-like flexible body which is foldable up or down onto itself to provide different thicknesses and has, at or close to a lower edge, a central region with portions of the body on opposite widthwise sides of the central region providing a relatively larger thickness and hence firmer support than the central region; and a wrapper for wrapping the adjuster atop the sleeping pillow and having fasteners for securing opposite ends of the wrapper to each other when the wrapper is wrapped around the adjuster and the sleeping pillow.

11. A combination as claimed in claim 10 wherein the fasteners comprises hook-and-loop fasteners.

12. A combination as claimed in claim 10 wherein the fasteners are hidden from outside the wrapper when the ends are secured to each other by the fasteners.

13. A combination as claimed in claim 10 wherein the opposite ends of the wrapper overlap each other when secured to each other by the fasteners.

14. A combination as claimed in claim 10 wherein the wrapper is rectangular with a width matching a width of the adjuster.

15. A combination comprising:

a sleeping pillow; and an adjuster disposed on the pillow and extending in a widthwise direction of the pillow and comprising a sheet-like flexible body which is foldable up or down onto itself to provide different thicknesses and has, at or close to a lower edge, a central region disposed on the pillow with portions of the body on opposite widthwise sides of the central region providing a relatively larger thickness and hence firmer support than the central region.

* * * * *